United States Patent [19]

Sheu

[11] Patent Number: 4,957,383

[45] Date of Patent: Sep. 18, 1990

[54] LEAD PROPELLING DEVICE FOR AN AUTOMATIC PENCIL

[76] Inventor: Jia-Ming Sheu, Fl., 11-7, No. 3, Fu-Shin 2nd Rd., Ling-ya Dist., Kaohsiung, Taiwan

[21] Appl. No.: 336,076

[22] Filed: Apr. 11, 1989

[51] Int. Cl.[5] ..... B43K 21/22

[52] U.S. Cl. ..... 401/55; 401/81

[58] Field of Search ..... 401/81, 84, 82, 80, 401/67, 65, 53, 54, 94

[56] References Cited

U.S. PATENT DOCUMENTS

| | | | |
|---|---|---|---|
| 1,737,862 | 12/1929 | Morris | 401/81 |
| 3,864,046 | 2/1975 | Butka | 401/53 |
| 4,478,529 | 10/1984 | Morio | 401/67 |
| 4,705,419 | 11/1987 | Niemeyer | 401/81 |

FOREIGN PATENT DOCUMENTS

| | | | |
|---|---|---|---|
| 2153400 | 10/1971 | Fed. Rep. of Germany | 401/81 |

*Primary Examiner*—Richard J. Johnson

*Attorney, Agent, or Firm*—Christensen, O'Connor, Johnson & Kindness

[57] ABSTRACT

A lead propelling device for an automatic pencil includes an upper tubular body which has a through-hole tapering downward and a first lead clamping face at the lower end of the through-hole, the tubular body being split along an axial plane thereof to permit the first clamping face to move between a clamping position and a releasing position, and a corrugated hollow member connected to the tubular member and having a corrugated wall with a plurality of indented annular portions defining second lead clamping faces which are movable between a clamping position and a releasing position thereof. The second clamping faces are in the clamping position when the first clamping face is in the releasing position thereof. A cone-shaped lead guide member is provided in the tapered end of the pencil tube and has a bottommost tube portion to protrude outward from the tapered end. The lead guide member is movable between a protruding position and a retracted position to propel and draw in the lead rod.

8 Claims, 3 Drawing Sheets

LEAD PROPELLING DEVICE FOR AN AUTOMATIC PENCIL

BACKGROUND OF THE INVENTION

This invention relates to an automatic pencil, and particularly to a lead propelling device for an automatic pencil.

An object of the invention is to provide an automatic pencil with a lead propelling device having a simplified construction which reduces cost and permits easy assembly.

SUMMARY OF THE INVENTION

According to the present invention, a lead propelling device for an automatic pencil comprises an upper tubular body which has an upper end secured to an inner side of the lower tapered end of a pencil tube and which has a through-hole tapering downward for receiving a lead rod and a first lead clamping face at a lower end of the through-hole, the tubular body being split along an axial plane thereof to permit the first clamping face to move between a clamping position and a releasing position, a corrugated hollow member connected to the tubular member adjacent to the lower end of the through-hole, the corrugated hollow member having a corrugated wall with a plurality of indented annular portions defining second lead clamping faces, the corrugated hollow member being expandable and contractible, and the second lead clamping faces being movable between a clamping position and a releasing position thereof, the second clamping faces being in the clamping position when the first clamping face is in the releasing position thereof, a cone-shaped lead guide member provided in the tapered end of the pencil tube and having a bottommost tube portion to protrude outwardly of the tapered end, the lead guide member further having a cone-shaped cavity communicated with the corrugated hollow member and a lead receiving hole which is communicated with the cone-shaped cavity and which extends to the bottommost tube portion, the lead guide member being movable to place the bottommost portion in a protruding position and a retracted position; and a spring means for urging the corrugated hollow member and the lead guide member to the clamping and the protruding positions respectively.

In one aspect of the invention, the corrugated wall includes a plurality of cone-shaped wall portions which converge downward and a plurality of horizontal annular wall portions interconnecting the cone-shaped wall portions, the cone-shaped wall portions and the horizontal wall portions forming acute angles whose tips define the second lead clamping faces. The upper tubular body is provided with a radial annular flange to engage with an inner surface of the pencil tube. The corrugated wall has a substantially cone-shaped wall portion which converges at the lower end of the through-hole of the upper tubular member and is connected to the corrugated wall thereat.

The upper tubular body and the corrugated wall may be of one piece with one another The cone-shaped lead guide member has an upper end adjacent to the corrugated hollow member, the upper end being provided with an upward diverging flange which confines the cone-shaped cavity. The corrugated wall has a bottommost horizontal annular wall portion at a lower end thereof, the bottommost horizontal annular wall portion has a periphery thereof engaged with the upward diverging flange of the lead guide member. The spring means is a coil spring provided around the corrugated wall of the corrugated hollow member and engaged with the corrugated wall of the piston where the acute angles are formed.

The exemplary preferred embodiment will be described with reference to the accompanying drawings, in which,:

BRIEF DESCRIPTION OF THE PREFERRED EMBODIMENT

DETAILED DESCRIPTION OF THE PREFERRED EMBODIMENT

Figure 1:
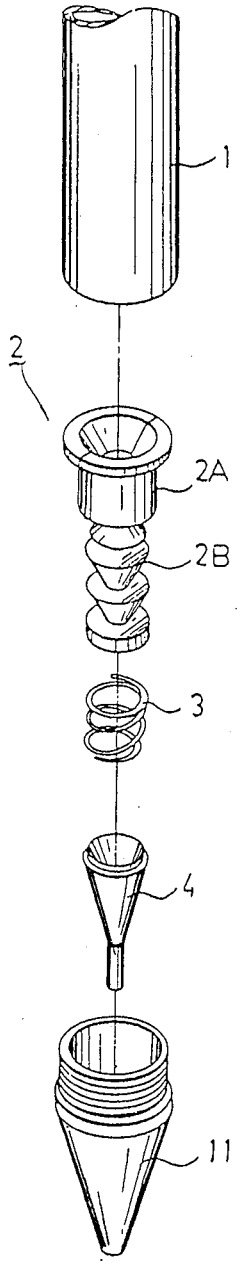
FIG. 1 is an exploded view of a lead propelling device according to the present invention.
Figure 2:
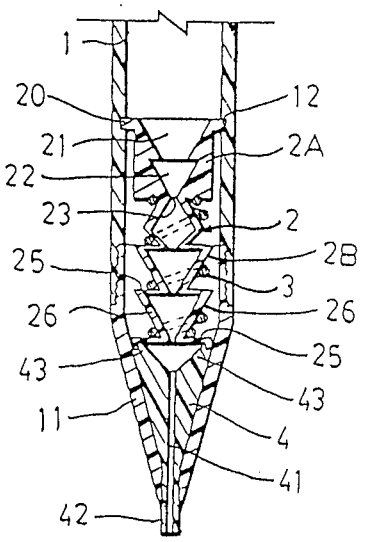
FIG. 2 is a sectional view of the device of FIG. 1.

Referring to the drawings, a portion of an automatic pencil is shown, including a lower portion of a pencil tube 1 and a tapered lower end 11 threadedly connected to the tube 1. A lead clamping means 2 and a spring means 3 is provided in the lower portion of the tube 1, A lead guide member 4 is provided in the tapered end 11.

The lead clamping means 2 includes an upper tubular portion 2A which has an upper truncated cone-shaped hole portion 21 and a lower cone-shaped hole portion 22. The lower end of the hole portion 22 defines a lead clamping face 23. The upper end of the tubular portion 2A is provided with an annular flange 20 which is engaged in an annular groove 12 of the pencil tube 1. The tubular portion 2A is split along an axial plane thereof so that the tubular portion can expand and contract slightly and the clamping face 23 can be moved to a clamping position and a releasing position.

The lead clamping means 2 further has a corrugated hollow member 2B which is one piece with the upper tubular portion 2A. The corrugated hollow member 2B has a converging end communicated with the hole portion 22 of the upper tubular portion 2A. The wall of the corrugated hollow member diverges from the converging end and then forms three cone-shaped wall portions 26 which converge downward and which are interconnected by horizontal connecting wall portions 25. Also, At the bottom of the corrugated hollow member 2B is a horizontal extending wall portion 25 which is connected to an upper end of the lead guide member 4. The cone-shaped wall portions 26 and the horizontal wall portions define three acute angles whose tips form three clamping faces i, j, k. The corrugated hollow member is axially expandable and contractible, and the second lead clamping faces are movable between a clamping position and a releasing position thereof. The second clamping faces are in the clamping position when the clamping face 23 is in the releasing position thereof.

The cone-shaped lead guide member 4 is provided in the tapered end of the pencil tube 1 and has a bottommost tube portion 42 to protrude outward from the tapered end. The upper end of the lead guide member 4 has two upward flanges 43 which are engaged with the ends of the bottommost horizontal wall portions 25 of the corrugated hollow member 2B. The flanges 43 confine a cone-shaped through-hole communicated with the corrugated hollow member 2B. The lead guide member 4 further has a lead receiving hole. 41 which is communicated with the cone-shaped through-hole and which extends to said bottommost tube portion. The lead guide member is movable so as to place the bottommost tube portion in a protruding position and a retracted position.

A coil spring 3 is provided around the corrugated hollow member 2B. The upper end of the coil spring is engaged in an annular groove formed by the upper tubular member 2A and the converging end of the corrugated hollow member 2B. The lower end of the coil spring 3 is engaged in a groove formed by one of the cone-shaped wall portion 26 and the bottom horizontal wall portion 25. Normally, the coil spring 3 urges downward the corrugated hollow member 2B as well as the bottommost tube portion 42. In this situation, the clamping faces i, j, k are in their clamping positions.

Figure 3:
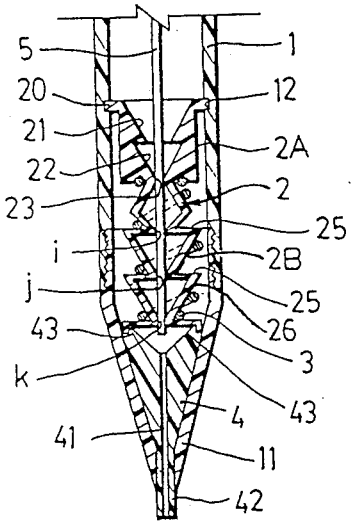
FIGS. 3 to 6 show different positions of the device.
Figure 4:
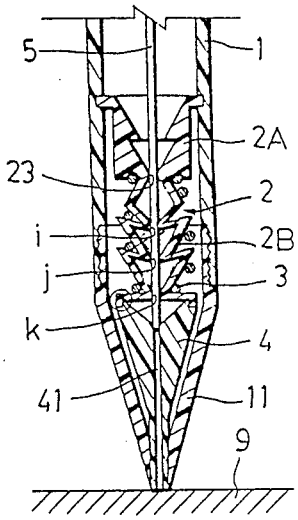
Figure 5:
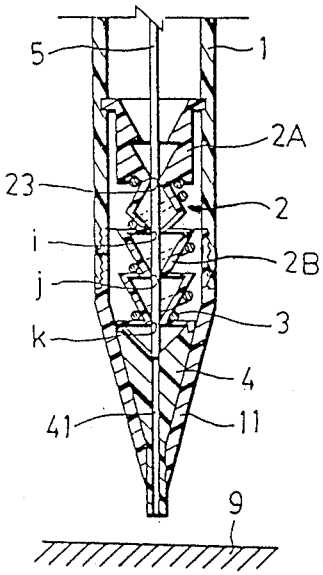
Figure 6:
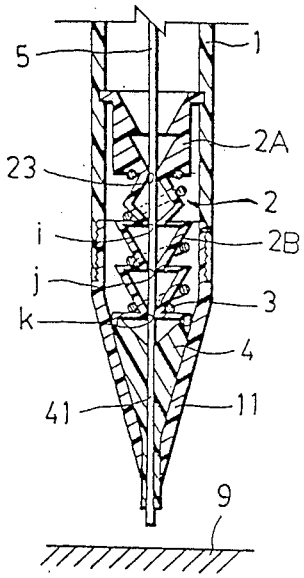

Referring to FIGS. 3 to 5, an elongated lead rod is pushed towards the clamping means 2 until the lead rod extends to a position below the corrugated hollow member 2B by a lead supplying means (not shown) which is usually provided in the upper portion of a pencil. Since the lead supplying means does not form any part of the present invention, it is not described herein. When the pencil tube is pressed against a surface of a table or the like, the bottommost tube portion 42 is forced into the tapered end of the pencil tube. As the tube portion 42 moves inward, the upper flanges 43 push the two ends of the bottommost horizontal wall portion 25. Due to the upward forces at the two ends of the bottommost horizontal wall portion 25 and the downward force of the coil spring, the clamping faces i, j, k move slightly out of their clamping positions. While the clamping faces i, j, k release the lead, the lead does not drop since the compression of the corrugated hollow member 2B causes the clamping face 23 of the split upper tubular member 2A to contract so as to clamp the lead.

When the pressure on the pencil is removed, the bottommost tube portion 42 protrudes downward, the clamping faces i, j, k move downward and clamps the lead, thereby moving downward the lead rod a certain distance. In this situation, the portion of the upper tubular member 2A that defines the clamping face 23 to expand so as to cause the clamping face 23 release the lead. If the pencil is a new one or is supplied with a new lead rod, repeated depression of the bottommost tube portion 42 is needed to propel the lead.

With the invention thus explained, it is apparent that various modifications and variations can be made without departing from the scope of the invention. It is therefore intended that the invention be limited only as indicated in the appended claims.

What I claim is:

1. A lead propelling device for an automatic pencil which has a pencil tube with a lower tapered end and a lead supplying means in an upper portion of the pencil tube comprising:

an upper tubular body which has an upper end secured to an inner side of the lower tapered end of the pencil tube and which has a through-hole tapering downward for receiving a piece of lead and a first lead clamping face at a lower end of said through-hole, said tubular body being split along an axial plane thereof to cause said first clamping face to move between a clamping position and a releasing position, a corrugated hollow member connected to said tubular member adjacent to said lower end of said through-hole, said corrugated hollow member having a corrugated wall with a plurality of indented annular portions defining second lead clamping faces, said corrugated hollow member being expandable and contractible, and said second lead clamping faces being movable between a clamping position and a releasing position thereof, said second clamping faces being in the clamping position when said first clamping face is in the releasing position thereof, a cone-shaped lead guide member provided in said tapered end of said pencil tube and having a bottommost tube portion which protrudes outward from said tapered end, said lead guide member further having a cone-shaped cavity communicated with said corrugated hollow member and a lead receiving hole which is communicated with said cone-shaped cavity and which extends to said bottommost tube portion, said lead guide member being movable to place said bottommost portion in a protruding position and a retracted position, and a spring means for urging said corrugated hollow member and said lead guide member to the clamping and the protruding positions respectively.

2. A lead propelling device as claimed in claim 1, wherein said corrugated wall of said corrugated hollow member includes a plurality of cone-shaped wall portions which converge downward and horizontal annular wall portions interconnecting said cone-shaped wall portions, said cone-shaped wall portions and said horizontal wall portions forming acute angles whose tips define second lead-clamping faces, said corrugated hollow member being expandable and contractible, and said second lead-clamping faces being movable between a clamping position and a releasing position thereof, said second clamping faces being in the clamping position when said first clamping face is in the releasing position thereof.

3. A lead propelling device as claimed in claim 2, wherein said upper tubular body is provided with a radial annular flange to engage with an inner surface of said pencil tube, said corrugated wall having a substantially cone-shaped wall portion which converges at said lower end of said through-hole of said upper tubular and is connected to said corrugated wall thereat.

4. A lead propelling device as claimed in claim 3, wherein said upper tubular body and said corrugated wall are of one piece with one another.

5. A lead propelling device as claimed in claim 3, wherein said cone-shaped lead guide member has an upper end adjacent to said corrugated hollow member, said upper end being provided with an upward diverging flange which confines said cone-shaped cavity.

6. A lead propelling device as claimed in claim 5, wherein said corrugated wall has a bottommost horizontal annular wall portion at a lower end thereof, said bottommost horizontal annular wall portion having a periphery thereof engaged with said upward diverging flange of said lead guide member.

7. A lead propelling device as claimed in claim 6, wherein said spring means is a coil spring provided around said corrugated wall of said corrugated hollow member and engages with said corrugated wall where said acute angles are formed.

8. A lead propelling device as claimed in claim 3, wherein said through-hole of said upper tubular body is stepped and includes an upper truncated cone-shaped hole portion and a lower cone-shaped hole portion.

* * * * *